US010132095B2

(12) United States Patent
Liu

(10) Patent No.: US 10,132,095 B2
(45) Date of Patent: Nov. 20, 2018

(54) POOL APPARATUS

(71) Applicant: Bestway Inflatables & Material Corp., Shanghai (CN)

(72) Inventor: Feng Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 4 days.

(21) Appl. No.: 15/153,341

(22) Filed: May 12, 2016

(65) Prior Publication Data

US 2017/0101793 A1 Apr. 13, 2017

(30) Foreign Application Priority Data

Oct. 10, 2015 (CN) ..... 2015 1 0653979
Oct. 10, 2015 (CN) ..... 2015 2 0785263 U

(51) Int. Cl.
*E04H 4/00* (2006.01)

(52) U.S. Cl.
CPC ... *E04H 4/0025* (2013.01); *E04H 2004/0068* (2013.01)

(58) Field of Classification Search
CPC . E04H 4/0025; E04H 2004/0068; A47K 3/06; A61H 2201/0103
USPC ..... 4/588
See application file for complete search history.

(56) References Cited

U.S. PATENT DOCUMENTS 5,490,295 A * 2/1996 Boyd ..... A47C 27/081 5/687
5,865,564 A * 2/1999 Miller ..... E02B 3/108 405/114
5,924,144 A * 7/1999 Peterson ..... E04H 4/10 4/488
2007/0277324 A1 12/2007 Liu
2012/0031265 A1* 2/2012 Song ..... A47C 27/081 92/145
2013/0318703 A1* 12/2013 Berenson ..... A63G 21/18 4/494
2015/0020306 A1* 1/2015 Lin ..... A61H 33/028 4/585

FOREIGN PATENT DOCUMENTS

CH 438622 A 6/1967
EP 3165691 A2 5/2017

* cited by examiner

*Primary Examiner* — J. Casimer Jacyna
(74) *Attorney, Agent, or Firm* — AJ Moss; Dickinson Wright PLLC

(57) ABSTRACT

A pool apparatus configured to carry liquids has a side wall and a bottom surface. The side wall has a plurality of structure drawstrings, an outer side wall, and an inner side wall. Two sides of the structure drawstrings draw respectively the outer side wall and the inner side wall, so as to maintain a predetermined shape of the pool apparatus. The structure drawstrings include a main drawstring portions and at least two branch drawstring portions. The main drawstring portions have a first main string side configured to connect a first branch drawstring side of the at least two branch drawstrings. A second branch string side of the at least two branch drawstrings connects respectively to different positions of the outer side wall and the inner side wall.

18 Claims, 11 Drawing Sheets

POOL APPARATUS

FIELD OF THE INVENTION

The present invention is related to a pool apparatus, and more particular related to a pool apparatus having an ability to maintain the shape of a side wall thereof.

BACKGROUND

Water pools have very long history for various functions, such as being a swimming pool or for a massage bath. Some of water pools are manufactured by fixed structures, such as digging a hole in the ground and strengthening the waterproof pool surface at surroundings. Some water pools may install for the occasion, such as using a large plastic tarp with a supporting structure to consist a water accommodating structure.

For convenience of assembling, and considering at the same time, some of water pools made by tarps generate forces required to maintain basic structures of water pools by inflation. However, since plastic coatings are under pressures of gases at each position after inflation, which may result in ugly shapes of water pools, or even influencing operation function. As a result, how to design to let water pools to maintain predetermined shapes, and at the same time capable of using less materials and less costs to provide higher strength and durability becomes very valuable works.

SUMMARY OF THE INVENTION

The first embodiment of the invention provides a pool apparatus. The pool apparatus may be configured to carry liquids like water, etc., providing people to swim, bath or to act as other purposes in it. The width of the water pool may be larger than one meter or two meters for example. The pool apparatus have at least one side wall and a bottom surface. However, it must be noted that, the scopes of the invention are not limited by the above mentioned sizes.

The side wall includes at least one structure drawstrings, an outer side wall and an inner side wall. The two sides of the structure drawstrings draw respectively the outer side wall and the inner side wall, so as to maintain a predetermined shape of the pool apparatus. The structure drawstrings include a main drawstring portions and at least two branch drawstring portions.

The main drawstring portions have a first main drawstring side. The at least two branch drawstring portions have a first branch string side. The first main drawstring sides of the main drawstring portions connects to the first branch string side of the at least two branch drawstring portions. In addition to the first branch string side, the at least two branch drawstring portions have another second branch string side, connecting respectively to different positions of the outer wall or the inner wall. In other words, the main drawstring portions may connect to two or more than two branch drawstring portions. There may be one, two, or more than two structure drawstrings portions inside the side wall.

In addition, the description on the branch drawstring portions which may connect to the outer wall or the inner wall mentioned above, is mainly pointed to two different ways of embodiments: the connection of the branch drawstring portions to the outer side wall, and the connection of the branch drawstring portions to the inner side wall. Also, in addition to setting the branch drawstring portions on one side of the main drawstring portions, the branch drawstring portions may also be set on another side of the main drawstring portions. Wherein, if the number of the branch drawstring portions are two, it looks like Y shape with collocation to the main drawstring portions. Therefore, these kinds of structure drawstrings may be named "Y drawstring". In addition, if the two sides of the main drawstring portions are all configured with two branch drawstring portions, they may be named "X drawstring".

The bottom surface connects to the side wall, so as to form together to be one portion of the structure body for carrying liquids. In some embodiments, the pool apparatus processes surrounding as the only one side wall by only the above mentioned side wall. However, according to different design requirements, the pool apparatus, in addition to the above mentioned side wall structure, other side walls may also be combined to the side wall, together to constitute the surrounding space of the water pool, so as to carry liquids like water. For example, a portion of the side wall of the water pool may be made of metals or plastics, in collocation with the above mentioned side walls to constitute a required structure of the water pool.

The above mentioned first branch string side of the at least two branch drawstring portions connect jointly with the main drawstring sides wall. Also, during inflation at inside of the side wall, the at least two branch drawstring portions separate from the connection part of the main drawstring portions with a first angle, connecting respectively to different positions of the outer side wall or the inner side wall, so that the outer side wall or the inner side wall with the connection portion of the structure drawstrings has drawing forces in at least two directions, composing a more stable stereotype structure.

If sheet drawstrings are directly connected to the inner side wall or the outer side wall, so as to provide drawing forces after the inflation of the side wall, the connection angle of the sheet drawstrings at the inner side wall or at the outer side wall usually close to perpendicular, and thus all stresses are sustained by the contact points. Therefore, the material of the connection portion should have enough thickness, or the pressure of inflation is required to be smaller than a certain limitation. Relatively, the pool apparatus described here have more than two branch drawstrings in connection with the inner side wall or the outer side wall. Therefore, the drawing forces mentioned above may be dispersed into two positions. In this condition, the angle of the connection between the branch drawstrings and the inner wall or (the angle between the branch drawstrings and) the outer wall are usually not perpendicular but smaller angle, such as an angle smaller than 80 degrees.

In addition, there may be many of the structure drawstrings of this kind. Also, the configuration between these structure drawstrings may be substantially parallel, and keeping a predetermined spacing distances with each other, so as to draw different positions of the inner side wall and the outer side wall, such that after the inflation of the pool apparatus, the inner side wall and the outer side wall maintain fixed shapes. The substantially parallel mentioned herein is not necessary the absolute parallel of the geometry, only no overlap and cross between the structure drawstrings is fine and also belonging to the substantially parallel herein.

The pool apparatus may be designed to be different shapes, such as a circle, a square with/without round corners, a rectangle, other polygons, or some other shapes meeting with aesthetics or coordinating the environment. The side wall forms a closed surrounding wall surface corresponding to a predetermined shape of the bottom surface. The surrounding wall surface and the bottom surface constitute a carrying space configured to carry liquids.

The above mentioned structure drawstrings are not necessary all in the pool apparatus. The pool apparatus may also include a plurality of ordinary drawstrings. The two sides of the ordinary drawstrings connect respectively to the inner side wall and the outer side wall, providing drawing forces similar to the ones provided by the above mentioned structure drawstrings. In addition, the ordinary drawstrings may be configured at the straight line portions of the predetermined shape. The structure drawstrings may be configured at the turning portions of the predetermined shapes.

In the portion of the height of the surrounding bottom surface, the side wall may maintain at the same height, and the side wall may also have different heights at different positions. These are all belonged to the scope covered by the invention.

As mentioned above, the branch drawstrings may be added on the two sides of the main drawstring portions. Specifically, the structure drawstrings of this kind may have at least more than two sub-branch drawstring portions. One of the ends of the sub-branch drawstring portions is partially connected to the main drawstring portions. Also, during the inflation at inside of the side wall, the sub-branch drawstring portions separate from the connection parts of the main drawstring portions with a second angle, and connecting respectively to different positions of the outer side wall or the inner side wall, so that the connection portions between the outer side wall or the inner side wall with the structure drawstrings has drawing forces in at least two directions, composing a more stable stereotype structure.

The main drawstring portions of the structure drawstrings and the branch drawstring portions have shapes substantially polygon strips respectively, and the shapes have at least one dip, so that airs may circulate with each other on the two sides of the structure drawstrings. Specifically, since the plurality of structure drawstrings or ordinary drawstrings may be set inside the side wall, the drawstring to some extent will block the circulation of airs inside the side wall. In some embodiments, the water pool may have a plurality of isolated gas chambers, and may also have only one common gas chamber. Therefore, the structure drawstrings or ordinary draw strings may be designed to have allowable dips, such as holes or notches, so that the gases inside the side wall pass through the structure drawstrings or (pass through) the ordinary drawstrings and flowing.

In addition to the side wall and the bottom surface, the pool apparatus may usually include a top sheet. The top sheet connects to the plurality of structure drawstrings, and the top sheet, the inner side wall, the outer side wall and the bottom surface constitute an air chamber. The air chamber holds up the side wall during the inflation, so as to form a space for carrying liquids with the bottom surface. In order to provide better experiences for users, the top sheets may be decorated by different colors, or even adding up various kinds of stereoscopic structures, so as to provide effects of aesthetic result or convenience for practical uses.

The bottom surface, the structure drawstrings and the side wall may be the same tape, tapes with different strengths, or may be other materials. For example, materials of the structures may be PVC tapes, or strengthened PVC tapes. Specifically, the structures may be constituted by adding nylon or polyester meshes between two slices or more than two slices of PVC tapes. In addition, drawstrings may be textiles of other materials or a structure bodies of other materials.

A high frequency manner may be used to weld between the flexible tapes. This manner is also named "high-frequency welding". Certainly, the flexible tapes may also be connected by various manners like glues, sewing buttons, or zippers, etc.

The other embodiment of the invention provides a pool apparatus comprising a side wall, a top sheet and a bottom surface. The side wall has an outer side wall, an inner side wall and a plurality of structure drawstrings. The two sides of the structure drawstrings draw respectively the outer side wall and the inner side wall, so as to maintain the pool apparatus to keep a predetermined shape. The structure drawstrings may include a main drawstring portions and at least two branch drawstring portions. The main drawstring portions has a first main drawstring sides, configured to connect a first branch string sides of the at least two branch drawstrings. A second branch string side of the at least two branch drawstrings connect respectively to different positions of the outer side wall or the inner side wall.

The top sheet constitutes a surrounding close shape. The top sheet connects the outer side wall along the outer periphery of the surrounding close shape. The top sheet connects the inner side wall along the inner periphery of the surrounding close shape.

The bottom surface connects to the side wall, and after the inflation of the side wall, the bottom surface and the side wall constituting a space for carrying liquids.

In addition to the structure drawstrings, the pool apparatus may also include a plurality of ordinary drawstrings. The two sides of the ordinary drawstrings connect respectively to the inner side wall and the outer side wall, capable of being configured at the straight line portions of the predetermined shape. The structure drawstrings may be configured at the turning portions of the predetermined shape.

The bottom surface, the top sheet, the outer side wall and the inner side wall mentioned herein may be flexible tapes. At least one air chamber is included inside the side wall, so that airs on the two sides of the structure drawstrings may pass through dips or holes of the structure drawstrings for circulation.

The structure drawstrings mentioned herein may have different kind of categories. For example, the main drawstring portions of the first structure drawstrings may be directly connected to the inner side wall or the outer side wall, and the second structure drawstrings further includes at least two sub-branch drawstring parts.

One of the ends of the sub-branch drawstring portions connects to the main drawstring portions. Also, during inflation at the inside of the side wall, the sub-branch drawstring portions separate from the connection part of the main drawstring portions with a second angle, and connect respectively to different positions of the outer side wall or the inner side wall, such that the connection portions of the outer side wall, the inner side wall, or the structure drawstrings have drawing forces in at least two different directions, composing a more stable stereotype structure.

Aside from the top sheet and the bottom surface of the inner side wall and the outer side wall, the shape may be fixed by only structure drawstrings of first kind. In other embodiments, aside from the top sheet and the bottom surface of the inner side wall and the outer side wall, and aside from the structure drawstrings of first kind, structure drawstrings of second kind may also be included to draw the inner side wall and the outer side wall, so as to maintain the shape of the pool apparatus.

By these designs of the embodiments, less materials may be used to bring stronger structure characteristics. In addition, compared to direct drawstrings, the above mentioned structure drawstrings may avoid stresses concentrating on one segments, providing more beautiful structure and avoiding the drawback of stresses concentration at the connection parts between the simple straight drawstrings and the pool wall. In addition, distractions of drawing forces may reduce the stripped problem at the connection parts. Or, one may achieve the required strength effect by less and simpler materials.

DETAILED DESCRIPTION

Figure 1:
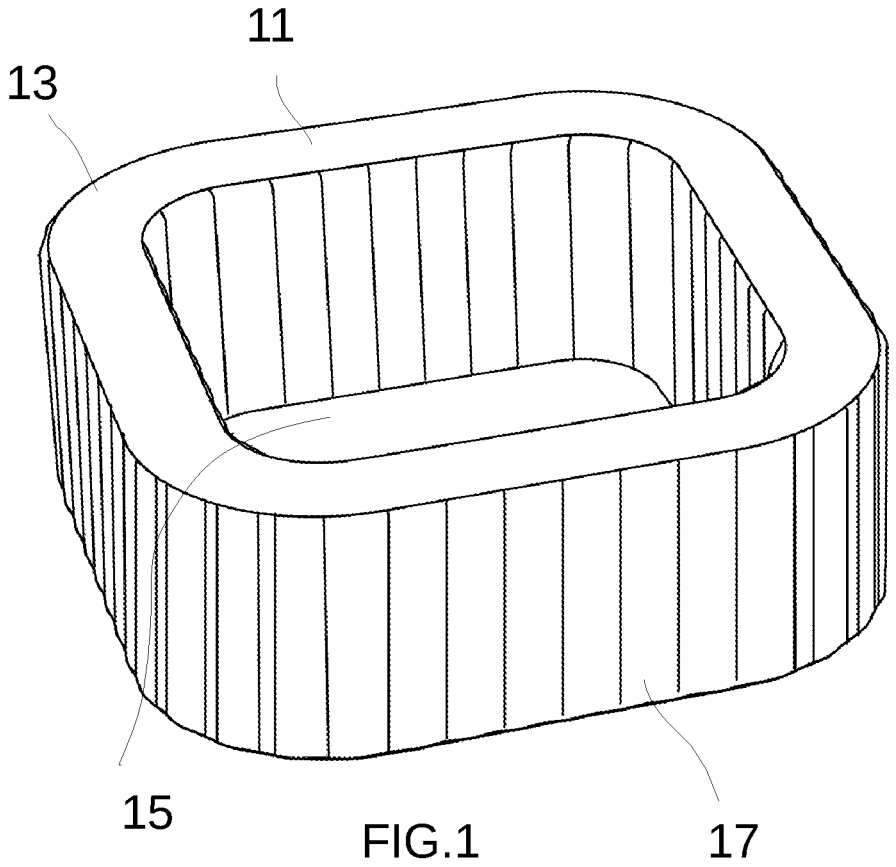
FIG. 1 exemplifies a stereogram of a square pool apparatus according to the first embodiment of the invention.

Refer to FIG. 1. FIG. 1 exemplifies a stereogram of a square pool apparatus 11 according to the first embodiment of the invention. The pool apparatus 11 has a top sheet 13, a bottom surface 15, and a surrounding side wall 17. The pool apparatus may be configured to carry liquids like water, providing people to swim, bath or to act as other purposes in it.

Figure 2:
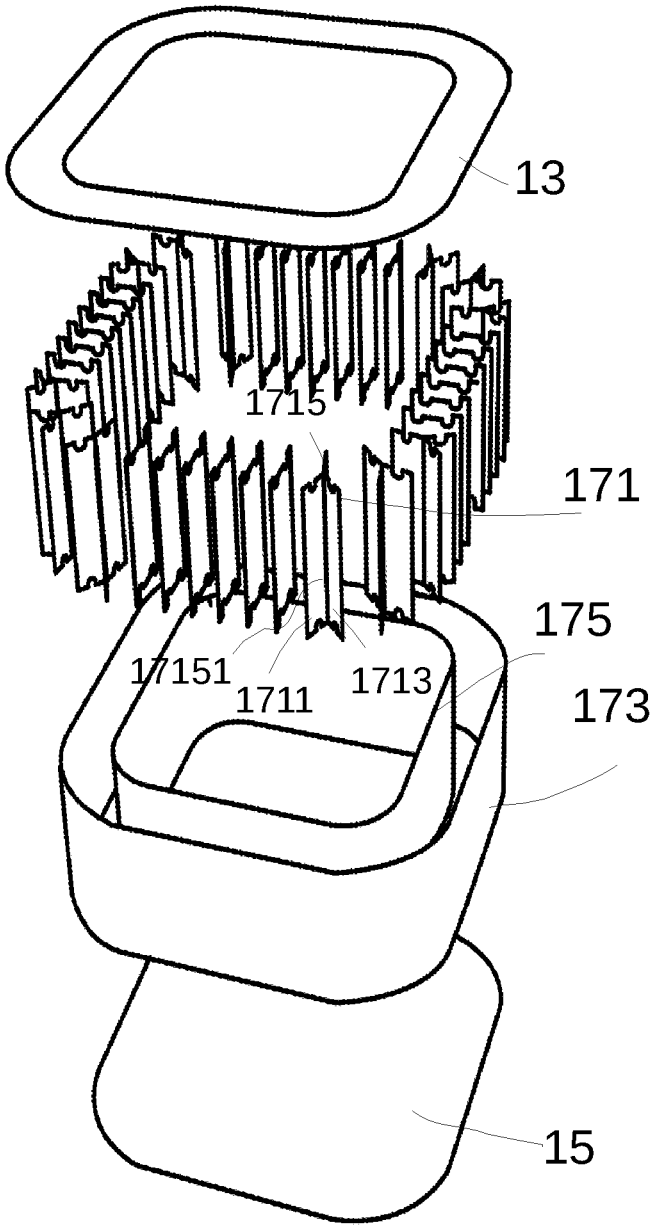
FIG. 2 exemplifies an exploded view of the pool apparatus of the first embodiment.

Refer to FIG. 2. FIG. 2 is a stereoscopic exploded view of the pool apparatus 11 of the embodiment in FIG. 1. The two sides of the structure drawstrings 171 draw respectively the outer side wall 173 and the inner side wall 175, so as to maintain the pool apparatus 11 to keep in a square shape of water pool. The structure drawstrings 171 include a main drawstring portions 1715 and at least two branch drawstring portions 1711, 1713.

In the example, the main drawstring portions 1715 have a first main drawstring sides 17151, configured to connect to a first branch string sides, i.e. the 20 overlap position with the main drawstring sides 17151 in the figure. In addition, a second branch string sides of the at least two branch drawstring portions 1711, 1713 are connected respectively to different positions of the outer side wall 173. In other words, the main drawstring portions 1715 may be connected to two or more than two branch drawstring portions 1711, 1713. One may have one, two, or more than two structure drawstring portions inside the side wall. As can be seen in the relationship of FIG. 2, between outer side wall 173, inner side wall 175, and branch drawstring portions 1711, 1713, each second branch drawstring side can be disposed at a non-parallel orientation to the inner side wall 175 or outer side wall 173 where each second branch drawstring side is connected to the inner side wall 175 or the outer side wall 173.

In addition, the description on the branch drawstring portions may be connected to the outer side wall or the inner side wall including two kinds of different embodiments: the connection of the branch drawstring portions to the outer side wall and the connection of the branch drawstring portions to the inner side wall. Also, in addition to setting the branch drawstring portions 1711, 1713 on onside of the main drawstring portions 1715, the branch drawstring portions may also be set on another side of the main drawstring portions 1715. If the number of the branch drawstring portions are two, it looks like Y shape with collocation to the main drawstring portions. Therefore, these kinds of structure drawstrings may be named "Y drawstring". In addition, if the two sides of the main drawstring portions are all configured with two branch drawstring portions, they may be named "X drawstring".

The bottom surface 15 connects to the side wall 17, so as to form together to be one portion of the structure body for carrying liquids. In some embodiments, the pool apparatus processes surrounding as the only one side wall by only the above mentioned side wall. However, according to different design requirements, the pool apparatus, in addition to the above mentioned side wall 17 structure, other side walls may also be combined to the side wall, together to constitute the surrounding space of the water pool, so as to carry liquids like water. For example, a portion of the side wall of the water pool may be made of metals or plastics, in collocation with the above mentioned side walls to constitute a required structure of the water pool.

The above mentioned first branch string side of the at least two branch drawstring portions 1711, 1713 connect jointly with the main drawstring sides wall 17151. Also, during inflation at inside of the side wall, the at least two branch drawstring portions 1711, 1713 separate from the connection part of the main drawstring portions 1715 with a first angle, connecting respectively to different positions of the outer side wall 173 or the inner side wall 175, so that the outer side wall 173 or the inner side wall 175 with the connection portion of the structure drawstrings 171 has drawing forces in at least two directions, composing a more stable stereotype structure.

If sheet drawstrings are directly connected to the inner side wall 175 or the outer side wall 173, so as to provide drawing forces after the inflation of the side wall 17, the connection angle of the sheet drawstrings at the inner side wall 175 or at the outer side wall 173 usually close to perpendicular, and thus all stresses are sustained by the contact points. Therefore, the material of the connection portion should have enough thickness, or the pressure of inflation is required to be smaller than a certain limitation. Relatively, the pool apparatus 11 described here have more than two branch drawstrings 1711, 1713 in connection with the inner side wall 175 or the outer side wall 173. Therefore, the drawing forces mentioned above may be dispersed into two positions. In this condition, the angle of the connection between the branch drawstrings 171 and the inner wall 175 or the angle between the branch drawstrings 171 and the outer wall 173 are usually not perpendicular but smaller angle, such as an angle smaller than 80 degrees.

In addition, there may be many of the structure drawstrings of this kind. Also, the configuration between these structure drawstrings 171 may be substantially parallel, and keeping a predetermined spacing distances with each other, so as to draw different positions of the inner side wall 175 and the outer side wall 173, such that after the inflation of the pool apparatus, the inner side wall 175 and the outer side wall 173 maintain fixed shapes. The substantially parallel mentioned herein is not necessary the absolute parallel of the geometry, only no overlap and cross between the structure drawstrings is fine and also belonging to the substantially parallel herein.

The pool apparatus 11 may be designed to be different shapes, such as a circle, a square with/without round corners, a rectangle, other polygons, or some other shapes meeting with aesthetics or coordinating the environment. The side wall forms a closed surrounding wall surface corresponding to a predetermined shape of the bottom surface. The surrounding wall surface and the bottom surface constitute a carrying space configured to carry liquids.

Figure 3:
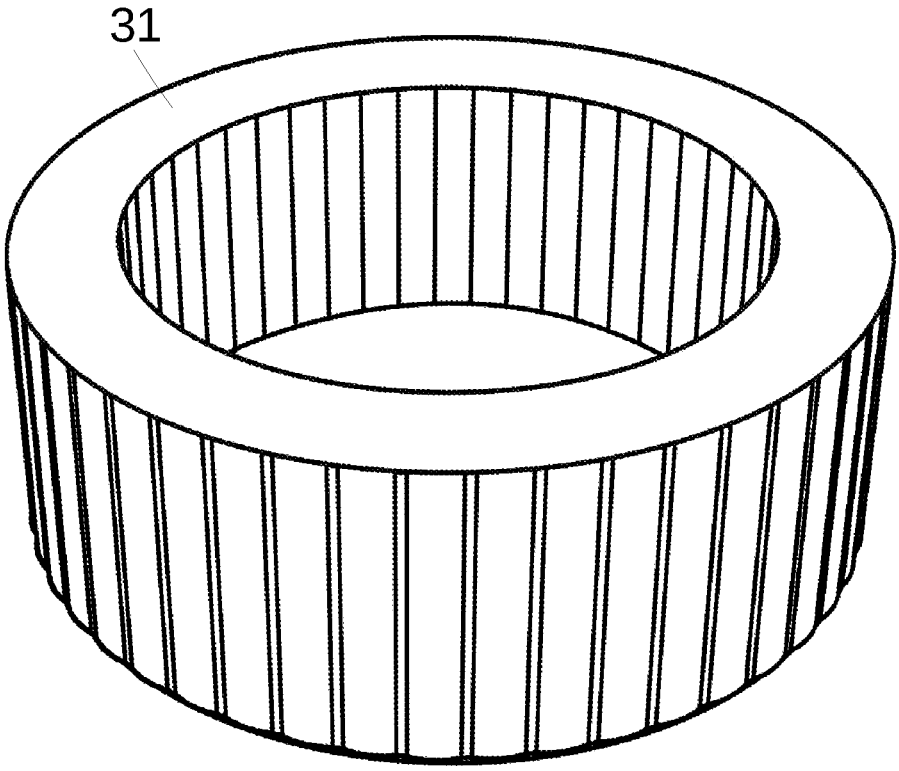
FIG. 3 exemplifies a stereogram of the circle water pool according to the second embodiment of the invention.

For example, refer to FIG. 3. FIG. 3 exemplifies an embodiment of a circle pool apparatus 31. The difference between the pool apparatus 31 and the one in FIG. 1 is the circle in shape. In other words, the water pool may be designed to more different shapes.

Figure 4:
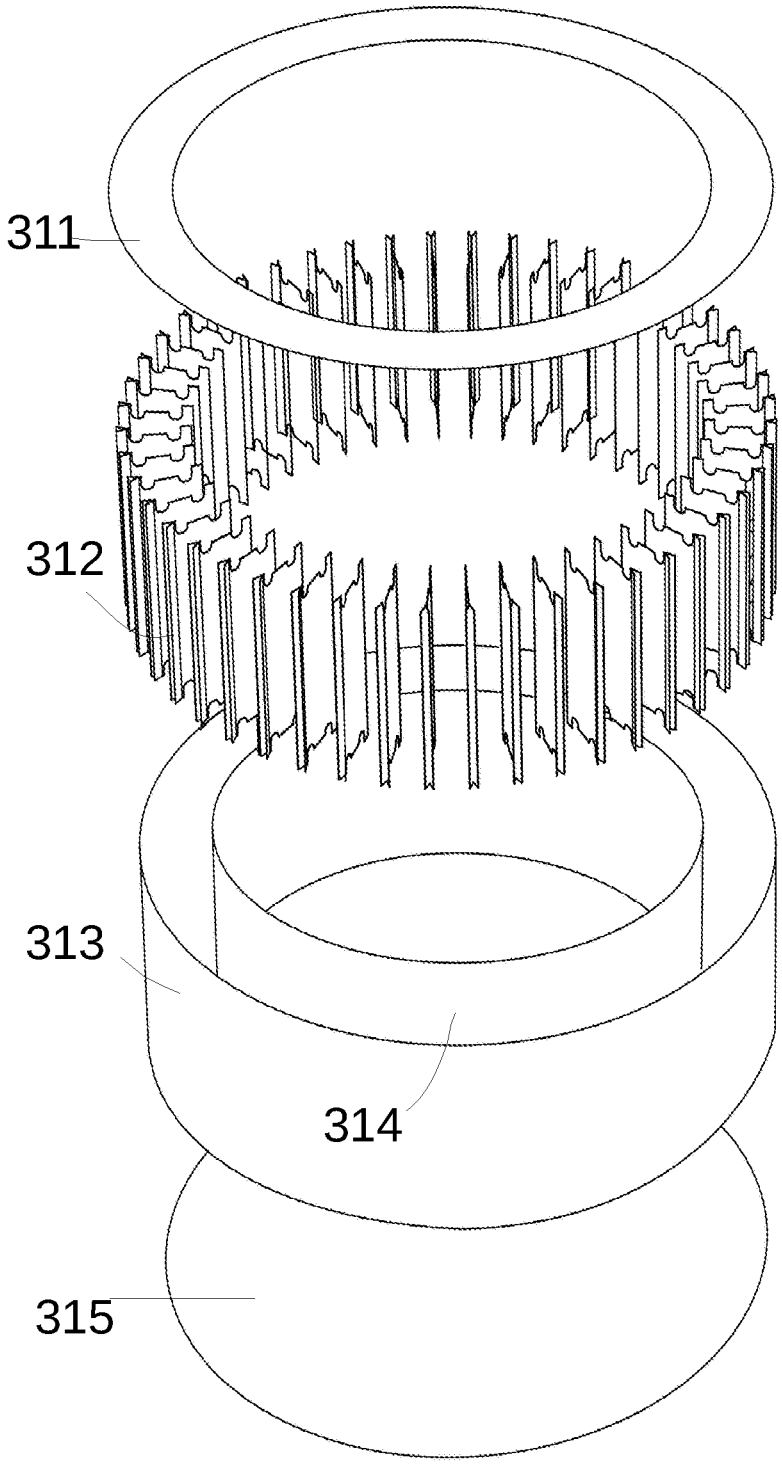
FIG. 4 exemplifies an exploded view of the pool apparatus of the second embodiment.

Refer to FIG. 4. FIG. 4 exemplifies an anatomy of the embodiment of FIG. 3. The pool apparatus has a circle top surface 311, a plurality of structure drawstrings 312, an outer side wall 313, an inner side wall 314, and a bottom surface 315.

Figure 5A:
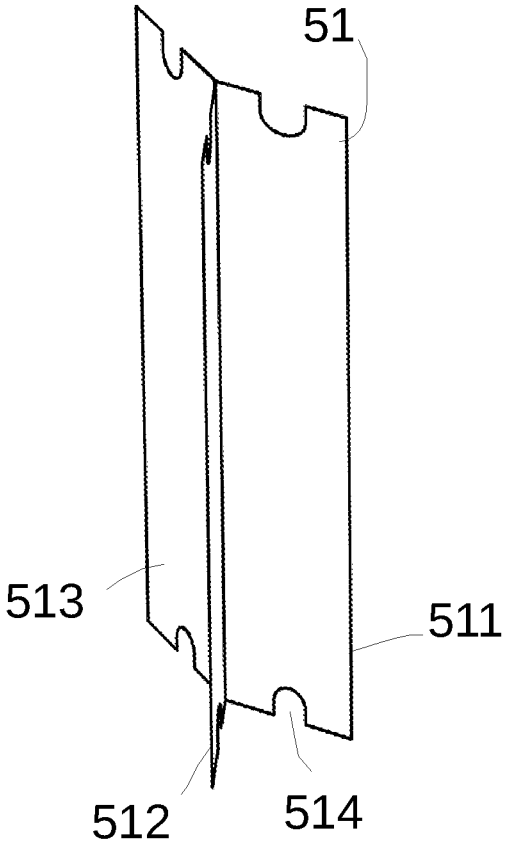
FIG. 5A exemplifies a stereoscopic schematic drawing of structure drawstrings of an embodiment.
Figure 5B:
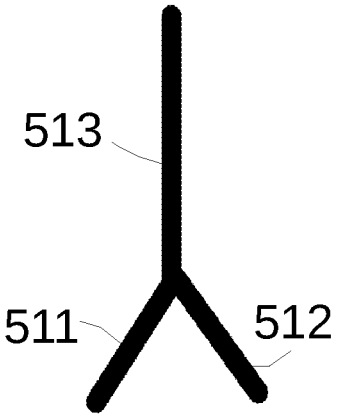
FIG. 5B exemplifies a top view of the structure drawstrings of the embodiment.

FIG. 5A exemplifies a stereoscopic schematic drawing of structure drawstrings of an embodiment. FIG. 5B exemplifies a top view of the structure drawstrings 51 of the embodiment. The structure drawstring 51 has two branch drawstring portions 511, 512 and a main drawstring portions 513. As mentioned above, to maintain air circulations, so as to process inflations using the same air chamber, some dips 514 may be set on the structure drawstring 51. It must be noted that, the dips are not necessary designed to be semicircles in the figure, those channels with other design ways which are convenient for inflation may achieve it.

Refer to FIG. 6A, FIG. 6B, FIG. 6C and FIG. 6D. FIG. 6A, FIG. 6B, FIG. 6C and FIG. 6D exemplify top views of some different kinds of variations of structure drawstrings. The structure drawstring in FIG. 6A has a main drawstring portion 601 and two branch drawstring portions 602, 603. In addition, the structure drawstring in FIG. 6A still has two sub-branch drawstring portions 604, 605.

In the embodiment with a structure drawstring, the main drawstring portion 610 is a connection part. Relatively, the branch drawstrings 607, 606 and the sub-branch drawstrings 608, 609 are hooked on the main drawstring portion 610.

In the embodiment with a structure drawstring, the main drawstring portion 615 is hooked with four branch drawstrings 611, 612, 613, and 614. Certainly, other numbers may be set according to different modeling of water pools or different requirements.

Figure 6A:
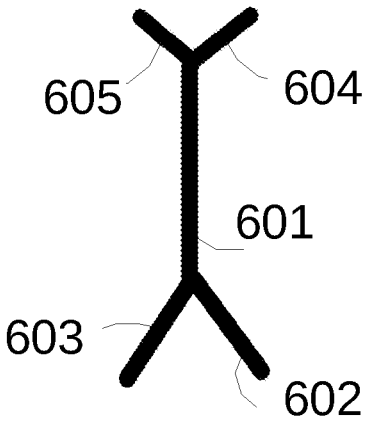
FIG. 6A exemplifies a top view of another structure drawstrings of an embodiment.
Figure 6B:
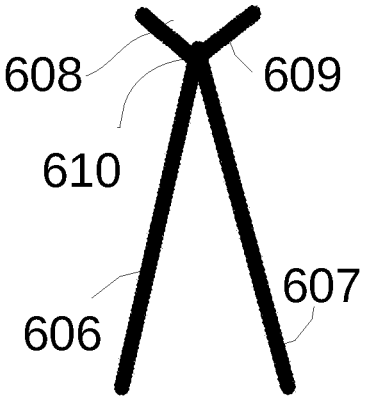
FIG. 6B exemplifies a top view of another structure drawstrings of an embodiment.
Figure 6C:
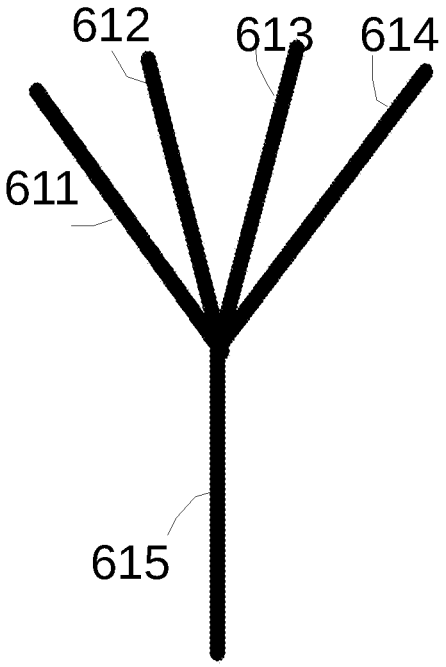
FIG. 6C exemplifies a top view of another structure drawstrings of an embodiment.
Figure 6D:
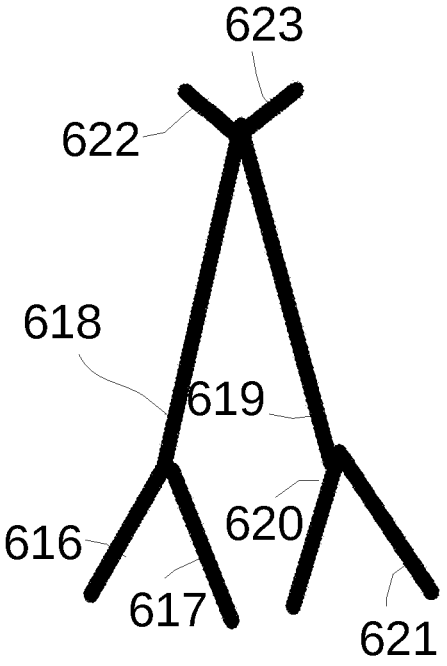
FIG. 6D exemplifies a top view of another structure drawstrings of an embodiment.

Refer to FIG. 6D. In the embodiment with a structure drawstring, the main drawstrings 618, 619 are hooked respectively with two sets of branch drawstring portions 616, 617, 620, 621. In addition, the connection portions of the main drawstrings 618, 619 are also hooked with the sub-branch drawstrings 622, 623.

Figure 7A:
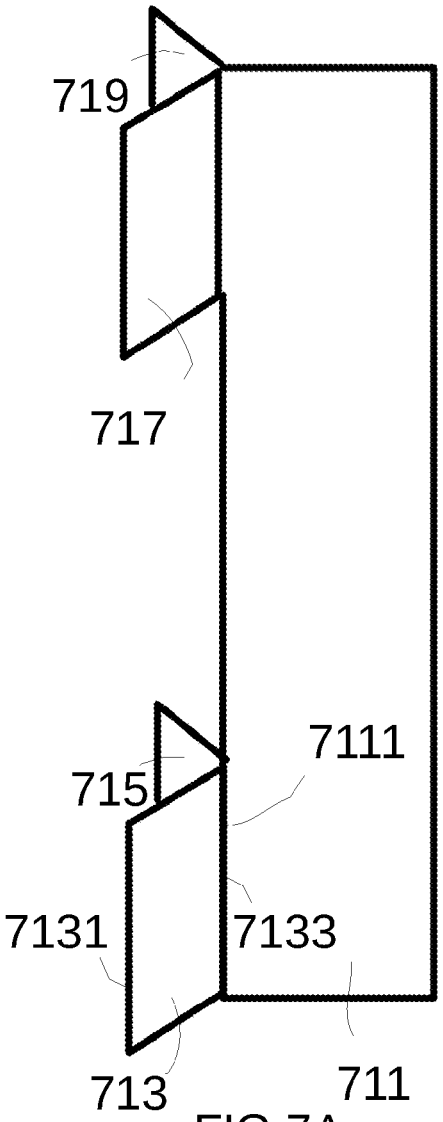
FIG. 7A exemplifies an embodiment of another structure drawstrings.

In FIG. 7A, the first main drawstring side 7111 of the main drawstring portion 711 is hooked with two branch drawstring portions 713, 715. The first branch string side 7133 of the branch drawstring portion 713 overlaps and sticks with the main drawstring side 7111. The second string side 7131 of the branch drawstring portion 713 connects to the inner side wall or the outer side wall.

Figure 7B:
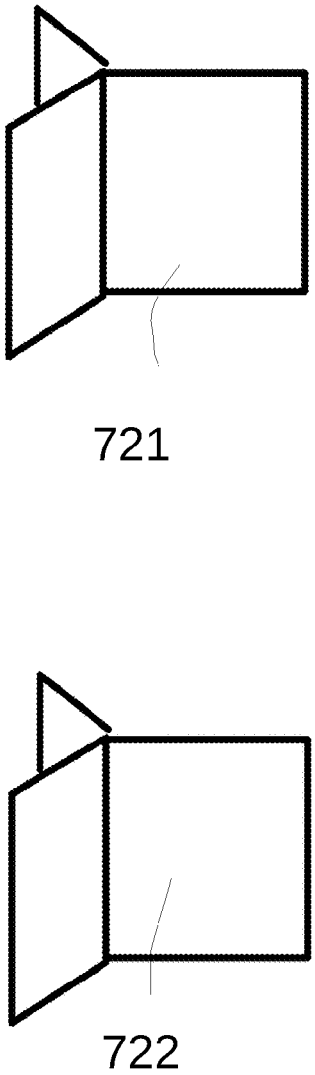
FIG. 7B exemplifies an embodiment of another structure drawstrings.

In FIG. 7B, there may be two structure drawstrings 721, 722 on the same horizontal positions, connected to different perpendicular positions of the inner side wall and the outer side wall. In other words, designers may design various kinds of structure drawstrings according to these illustrations.

Figure 8:
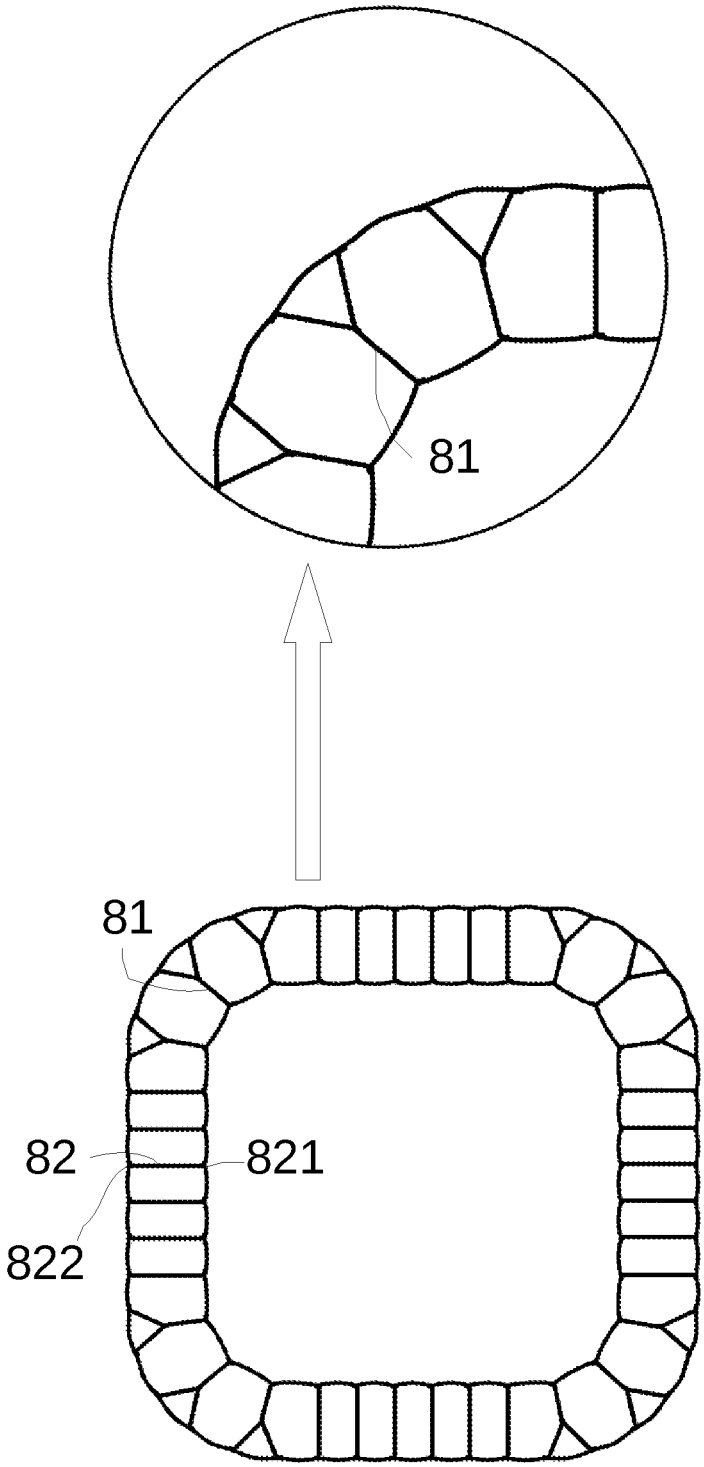
FIG. 8 exemplifies an embodiment of a square water pool using Y drawstrings and ordinary drawstrings.

Refer to FIG. 8. FIG. 8 exemplifies an embodiment of another kind of pool apparatus. In the embodiment, the pool apparatus does not entirely use the above mentioned structure drawstrings 81, and it may also include a plurality of ordinary drawstrings 82. The two sides 821, 822 of the ordinary drawstrings 82 connect respectively to the inner side wall and the outer side wall, providing drawing forces similar to the ones provided by the structure drawstrings 81. In addition, the ordinary drawstrings 82 may be configured at the straight line portions of the predetermined shape. The structure drawstrings 81 may be configured at the turning portions of the predetermined shape.

Figure 9:
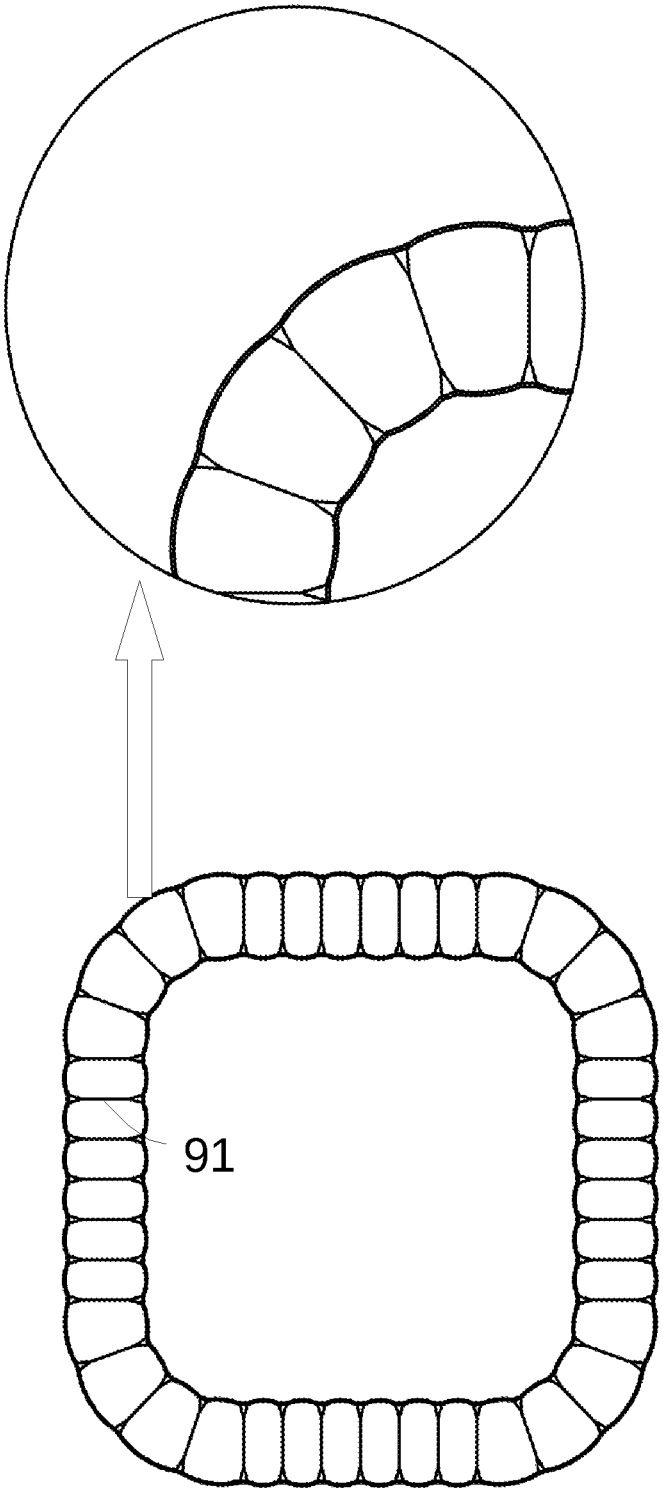
FIG. 9 exemplifies an embodiment of a square water pool with all using X drawstrings.

Refer to FIG. 9. FIG. 9 exemplifies an embodiment of a square pool apparatus. In the example, all the above mentioned X drawstrings 91 are used as the drawstrings (i.e. two ends of the main drawstrings have branch drawstrings).

Figure 10:
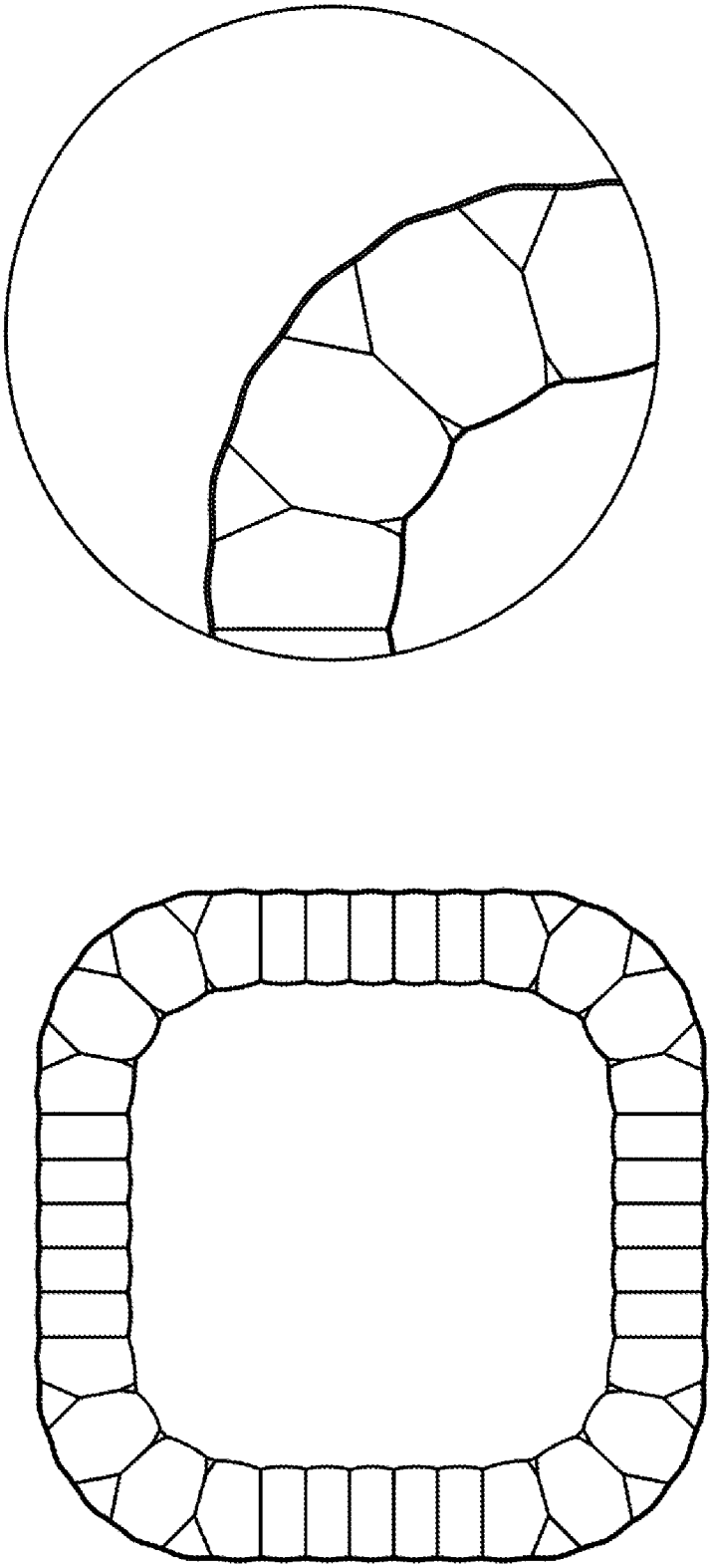
FIG. 10 exemplifies an embodiment of a square water pool using X drawstrings and ordinary drawstrings.

Refer to FIG. 10. FIG. 10 exemplifies an embodiment of a square pool apparatus. In the example, the embodiment uses the X drawstrings and the ordinary drawstrings.

Figure 11A:
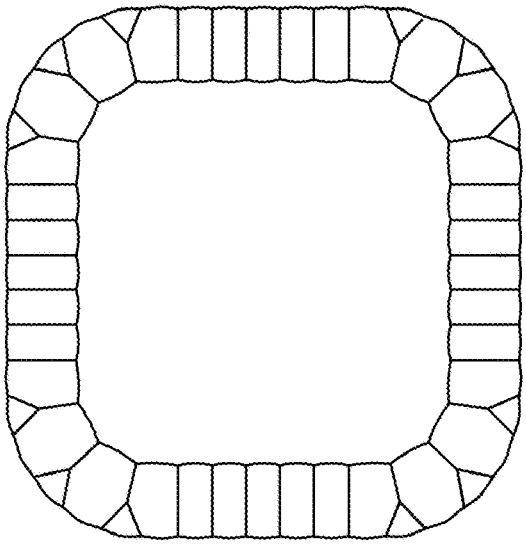
FIG. 11A exemplifies a square water pool using Y drawstrings.
Figure 11B:
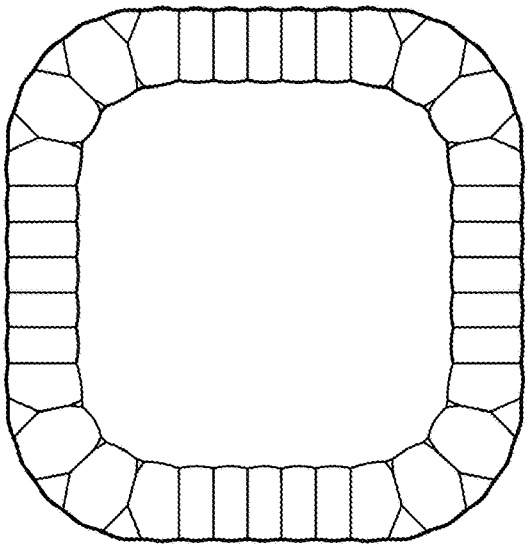
FIG. 11B exemplifies an embodiment of a square water pool using X drawstrings.

Different stress effects are generated by using different combinations. Refer to FIG. 11A and FIG. 11B. Although the two figures are square water pools, however, since the differences of using either X drawstrings or Y drawstrings, the final shape of the water pool will appear certain differences.

Which kind of combination to use depends on different design requirements and cost considerations. However, the examples provided herein should be enough for designers to design various kinds of deformation designs.

Besides, in the portion of the height of the surrounding bottom surface, the side wall may maintain at the same height, and the side wall may also have different heights at different positions. These are all belonged to the scope covered by the invention.

As mentioned above, the branch drawstrings may be added on the two sides of the main drawstring portions. Specifically, the structure drawstrings of this kind may have at least more than two sub-branch drawstring portions. One of the ends of the sub-branch drawstring portions is partially connected to the main drawstring portions. Also, during the inflation at inside of the side wall, the sub-branch drawstring portions separate from the connection parts of the main drawstring portions with a second angle, and connecting respectively to different positions of the outer side wall or the inner side wall, so that the connection portions between the outer side wall or the inner side wall with the structure drawstrings has drawing forces in at least two directions, composing a more stable stereotype structure.

The main drawstring portions of the structure drawstrings and the branch drawstring portions have shapes substantially polygon strips respectively, and the shapes have at least one dip, so that airs may circulate with each other on the two sides of the structure drawstrings. Specifically, since the plurality of structure drawstrings or ordinary drawstrings may be set inside the side wall, the drawstring to some extent will block the circulation of airs inside the side wall. In some embodiments, the water pool may have a plurality of isolated gas chambers, and may also have only one common gas chamber. Therefore, the structure drawstrings or ordinary draw strings may be designed to have allowable dips, such as holes or notches, so that the gases inside the side wall pass through the structure drawstrings or pass through the ordinary drawstrings and flowing.

In addition to the side wall and the bottom surface, the pool apparatus may usually include a top sheet. The top sheet connects to the plurality of structure drawstrings, and the top sheet, the inner side wall, the outer side wall and the bottom surface constitute an air chamber. The air chamber holds up the side wall during the inflation, so as to form a space for carrying liquids with the bottom surface. In order to provide better experiences for users, the top sheets may be decorated by different colors, or even adding up various kinds of stereoscopic structures, so as to provide effects of aesthetic result or convenience for practical uses.

The bottom surface, the structure drawstrings and the side wall may be the same tape, tapes with different strengths, or may be other materials. For example, materials of the structures may be PVC tapes, or strengthened PVC tapes. Specifically, the structures may be constituted by adding nylon or polyester meshes between two slices or more than two slices of PVC tapes. In addition, drawstrings may be textiles of other materials or a structure bodies of other materials.

A high frequency manner may be used to weld between the flexible tapes. This manner is also named "high-frequency welding". Certainly, the flexible tapes may also be connected by various manners like glues, sewing buttons, or zippers . . . etc.

The other embodiment of the invention provides a pool apparatus comprising a side wall, a top sheet and a bottom surface. The side wall has an outer side wall, an inner side wall and a plurality of structure drawstrings. The two sides of the structure drawstrings draw respectively the outer side wall and the inner side wall, so as to maintain the pool apparatus to keep a predetermined shape. The structure drawstrings may include a main drawstring portions and at least two branch drawstring portions. The main drawstring portions has a first main drawstring sides, configured to connect a first branch string sides of the at least two branch drawstrings. A second branch string side of the at least two branch drawstrings connect respectively to different positions of the outer side wall or the inner side wall.

The top sheet constitutes a surrounding close shape. The top sheet connects the outer side wall along the outer periphery of the surrounding close shape. The top sheet connects the inner side wall along the inner periphery of the surrounding close shape.

The bottom surface connects to the side wall, and after the inflation of the side wall, the bottom surface and the side wall constituting a space for carrying liquids.

In addition to the structure drawstrings, the pool apparatus may also include a plurality of ordinary drawstrings. The two sides of the ordinary drawstrings connect respectively to the inner side wall and the outer side wall, capable of being configured at the straight line portions of the predetermined shape. The structure drawstrings may be configured at the turning portions of the predetermined shape.

The bottom surface, the top sheet, the outer side wall and the inner side wall mentioned herein may be flexible tapes. At least one air chamber is included inside the side wall, so that airs on the two sides of the structure drawstrings may pass through dips or holes of the structure drawstrings for circulation.

The structure drawstrings mentioned herein may have different kind of categories. For example, the main drawstring portions of the first kind structure drawstrings may be directly connected to the inner side wall or the outer side wall, and the second kind structure drawstrings further includes at least two sub-branch drawstring parts.

One end of the sub-branch drawstring portions connects to the main drawstring portions. Also, during inflation at the inside of the side wall, the sub-branch drawstring portions separate from the connection part of the main drawstring portions with a second angle, and connect respectively to different positions of the outer side wall or the inner side wall, such that the connection portions of the outer side wall, the inner side wall, or the structure drawstrings have drawing forces in at least two different directions, composing a more stable stereotype structure.

Aside from the top sheet and the bottom surface of the inner side wall and the outer side wall, the shape may be fixed by only structure drawstrings of first kind. In other embodiments, aside from the top sheet and the bottom surface of the inner side wall and the outer side wall, and aside from the structure drawstrings of first kind, structure drawstrings of second kind may also be included to draw the inner side wall and the outer side wall, so as to maintain the shape of the pool apparatus.

The above mentioned square or circle water pool structures are only used as examples for illustrations. For example, squares may include rectangles of different adjacent sides, and circles may include ellipse, etc. In practical designs, may further design various polygons, curve models, and water pools of various kinds of object models by different relative configurations of the above mentioned drawstrings. For those using the above mentioned designs of drawstrings should all belong to the scopes of protection of the invention.

By these designs of the embodiments, less materials may be used to bring stronger structure characteristics. In addition, compared to direct drawstrings, the above mentioned structure drawstrings may avoid stresses concentrating on one segments, providing more beautiful structure and avoiding the drawback of stresses concentration at the connection parts between the simple straight drawstrings and the pool wall. In addition, distractions of drawing forces may reduce the stripped problem at the connection parts. Or, one may achieve the required strength effect by less and simpler materials.

The above mentioned are only preferred specific embodiments of the invention, and are not thence restrictive to the scope of claims of the invention. Therefore, those who apply equivalent changes according to the contents from the invention should all belong to the scope of the invention.

What is claimed is:

1. A pool apparatus configured to carry liquids, comprising:

at least one side wall, the side wall comprising at least one structure drawstring, an outer side wall, and an inner side wall, wherein the at least one structure drawstring draws the outer side wall and the inner side wall, so as to maintain a predetermined shape of the pool apparatus, the at least one structure drawstring comprising a main drawstring portion and at least two branch drawstring portions, the main drawstring portion having a first main drawstring side configured to connect with a first branch drawstring side of the at least two branch drawstrings, and second branch drawstring sides of the at least two branch drawstrings connect respectively to different positions of the outer side wall or the inner side wall, each second branch drawstring side being disposed at a non-parallel orientation to the inner or outer side wall where each second branch drawstring side is connected to the inner side wall or the outer side wall;

a bottom surface connecting to the side wall, so as to form together to be one portion of the structure body for carrying liquids; and wherein the predetermined shape includes one or more turning portions;

wherein the at least one structure drawstring is disposed along the one or more turning portions;

a plurality of drawstrings, each drawstring of the plurality of drawstrings comprising two sides connecting respectively to the inner side wall and the outer side wall, configured at one or more straight portions of the predetermined shape;

wherein each of the plurality of drawstrings is generally perpendicular to the corresponding inner side wall and the corresponding outer side wall whereto each of the plurality of drawstrings is connected.

2. The pool apparatus as claim 1, wherein the at least two branch drawstring portions connect jointly with the first main drawstring side wall, and during inflation at the inside of the side wall, the at least two branch drawstring portions separate from the connection part of the main drawstring portions with a first angle, connecting respectively to different positions of the outer side wall or the inner side wall, so that the outer side wall or the inner side wall with the connection portion of the structure drawstrings have drawing forces in at least two directions, composing a more stable stereotype structure.

3. The pool apparatus as claim 2, wherein the connection angles between the branch drawstring portions and the outer side wall and the angles between the branch drawstring portions and the inner side wall are smaller than 80 degrees.

4. The pool apparatus as claim 2, wherein the side wall has more than two structure drawstrings, the more than two structure drawstrings being substantially parallel and separating with a distance and drawing respectively different parts of the inner side wall and the outer side wall, such that after the inflation of the pool apparatus, the inner side wall and the outer side wall maintaining fixed shapes.

5. The pool apparatus as claim 4, wherein the side wall forms a closed surrounding wall surface corresponding to the predetermined shape; and wherein, the surrounding wall surface and the bottom surface constitute a carrying space configured to carry liquids.

6. The pool apparatus as claim 5, wherein the predetermined shape is one of a square, a rectangle, a square with elliptical corners, and a rectangle with elliptical corners.

7. The pool apparatus as claim 2, wherein the structure drawstrings further comprising at least two sub-branch drawstring portions, and one end of the at least two sub-branch drawstring portions connecting to the main drawstring portions, and during inflation at inside of the side wall, the at least two sub-branch drawstring portions separating from the connection parts of the main drawstring portions with a second angle, and connecting respectively to different positions of the outer side wall or the inner side wall, such that the connection portions of the outer side wall or the inner side wall, with the structure drawstrings having drawing forces in at least two different directions, composing a more stable stereotype structure.

8. The pool apparatus as claim 2, wherein the main drawstring portions of the structure drawstrings and the branch drawstring portions have shapes substantially polygon strips respectively, and the shapes have at least one dip, so that airs may circulate with each other on the two sides of the structure drawstrings.

9. The pool apparatus as claim 2, further comprising a top sheet connecting the plurality of structure drawstrings, and the top sheet, the inner side wall, the outer side wall and the bottom surface constituting an air chamber, holding up the side wall during the inflation, so as to form a space for carrying liquids with the bottom surface.

10. The pool apparatus as claim 1, wherein the bottom surface and the side wall are flexible tapes.

11. The pool apparatus as claim 9, wherein a high frequency manner is used to weld between the flexible tapes.

12. A pool apparatus comprising:

a side wall having an outer side wall, an inner side wall and a plurality of structure drawstrings, wherein the structure drawstrings draw the outer side wall and the inner side wall, so as to maintain the pool apparatus to keep a predetermined shape, and the structure drawstrings comprising a main drawstring portion and at least two branch drawstring portions, and the main drawstring portion having a first main drawstring side configured to connect with a first branch drawstring side of the at least two branch drawstrings, and a second branch drawstring side of the at least two branch drawstrings connecting respectively to different positions of the outer side wall or the inner side wall, each second branch drawstring side being disposed at a non-parallel orientation to the inner or outer side wall where each second branch drawstring side is connected to the inner side wall or the outer side wall;

a top sheet constituting a surrounding close shape, and the top sheet connecting the outer side wall along the outer periphery of the surrounding close shape, and the top sheet connecting the inner side wall along the inner periphery of the surrounding close shape;

a bottom surface connecting to the side wall, and after the inflation of the side wall, the bottom surface and the side wall constitutes a space for carrying liquids; and wherein the predetermined shape includes one or more turning portions; and wherein the plurality of structure drawstrings is disposed along the one or more turning portions;

a plurality of drawstrings, each drawstring of the plurality of drawstrings comprising two sides connecting respectively to the inner side wall and the outer side wall, configured at one or more straight portions of the predetermined shape;

wherein each of the plurality of drawstrings is generally perpendicular to the corresponding inner side wall and the corresponding outer side wall whereto each of the plurality of drawstrings is connected.

13. The pool apparatus as claim 12, wherein the connection angles between the branch drawstring portions and the outer side wall and the angles between the branch drawstring portions and the inner side wall are smaller than 80 degrees.

14. The pool apparatus as claim 12, wherein the bottom surface, the top sheet, the outer side wall and the inner side wall mentioned herein are flexible tapes.

15. The pool apparatus as claim 12, wherein the inside of the side wall comprises at least one air chamber, and air on two sides of the at least one structure drawstring is able to pass through dips or holes of the structure drawstrings for circulation.

16. The pool apparatus as claim 12, wherein the main drawstring portions of first structure drawstrings may be directly connected to the inner side wall or the outer side wall, and second structure drawstrings further comprises at least two sub-branch drawstring parts, and one end of the at least two sub-branch drawstring portions connects to the main drawstring portions, and during inflation at the inside of the side wall, the at least two sub-branch drawstring portions separate from the connection parts of the main drawstring portions with a second angle, and connect respectively to different positions of the outer side wall or the inner side wall, such that the connection portions of the outer side wall or the inner side wall, with the structure drawstrings have drawing forces in at least two different directions, composing a more stable stereotype structure.

17. The pool apparatus as claim 16, wherein aside from the top sheet and the bottom surface of the inner side wall and the outer side wall, the shape may be fixed by only the first structure drawstrings.

18. The pool apparatus as claim 16, wherein aside from the top sheet and the bottom surface of the inner side wall and the outer side wall, and aside from the first structure drawstrings, the second structure drawstrings may also be included to draw the inner side wall and the outer side wall, so as to maintain the shape of the pool apparatus.

* * * * *